US005435227A

United States Patent [19]

Frey et al.

[11] Patent Number: 5,435,227

[45] Date of Patent: Jul. 25, 1995

[54] OPERATING MECHANISM FOR A HYDRAULIC ACTUATOR HAVING A PRESSURE-PROPORTIONAL ACTUATING SIGNAL

[75] Inventors: Heinz Frey, Menziken; Kamil Prochazka, Windisch; Franz Suter, Gebenstorf, all of Switzerland

[73] Assignee: Asea Brown Boveri AG, Baden, Switzerland

[21] Appl. No.: 170,721

[22] Filed: Dec. 21, 1993

[30] Foreign Application Priority Data

Dec. 28, 1992 [DE] Germany ..... 42 44 304.0

[51] Int. Cl.[6] ..... F01B 31/12

[52] U.S. Cl. ..... 91/1; 91/442

[58] Field of Search ..... 60/399, 403, 406; 91/1, 91/363 R, 363 A, 442

[56] References Cited

U.S. PATENT DOCUMENTS

| | | | |
|---|---|---|---|
| 4,274,438 | 6/1981 | La Coste | 91/1 |
| 4,585,205 | 4/1986 | Coppola et al. | 91/363 R |
| 5,031,506 | 7/1991 | Baisch et al. | 91/363 R |
| 5,137,253 | 8/1992 | Frey et al. . | |

FOREIGN PATENT DOCUMENTS

0430089A1 6/1991 European Pat. Off. .

OTHER PUBLICATIONS

Handbook of Applied Instrumentation, New York, McGraw-Hill Book Company, 1964 pp. 4-15, 4-19, TA 165.C65h.

*Primary Examiner*—F. Daniel Lopez

*Attorney, Agent, or Firm*—Burns, Doane, Swecker & Mathis

[57] ABSTRACT

This operating mechanism for a hydraulic actuator (2) having a pressure-proportional actuating signal is provided with an amplifier (33) for electric signals, with at least one electrohydraulic transducer (24) connected upstream of the hydraulic actuator (2) and with a hydraulic discharge amplifier connected between the electrohydraulic transducer (24) and the actuator (2). The aim is to provide an operating mechanism for a hydraulic actuator having a pressure-proportional actuating signal which can be produced simply and cost-effectively. This is achieved by interconnecting between the actuator (2) and the hydraulic discharge amplifier a piston/cylinder arrangement (4) acting as a transducer.

10 Claims, 5 Drawing Sheets

OPERATING MECHANISM FOR A HYDRAULIC ACTUATOR HAVING A PRESSURE-PROPORTIONAL ACTUATING SIGNAL

BACKGROUND OF THE INVENTION

1. Field of the Invention

The invention proceeds from an operating mechanism for a hydraulic actuator in accordance with the preamble of claim 1.

2.Discussion of Background

Operating mechanisms for hydraulic actuators of conventional design are known, which are fitted with plunger coils which are expensive to produce. In addition, the mechanical components belonging to this operating mechanism are comparatively difficult and expensive to produce. An actuator for operating a control valve by means of which, for example, the steam feed to a turbine of a power plant is controlled has a main piston to which, on the one hand, spring force and, on the other hand, pressurized oil are applied. With reducing oil pressure, the spring force reliably closes the control valve, as a result of which the steam feed is interrupted. It is ensured as a result that the turbine does not run out of control should the oil pressure ever fail. The oil pressure in a drive volume which acts on the main piston and operates the control valve via said piston is controlled by a simple electrohydraulic transducer. Given a movement of the control valve in the opening direction, pressurized oil is fed into the drive volume, but because this movement takes place comparatively slowly, comparatively small cross sections are sufficient for feeding the oil. However, a closing movement of the control valve has to take place at a rate which is higher by at least a factor of ten. This causes a comparatively rapid emptying of the drive volume which, however, cannot be achieved by the small cross sections of the oil feed. It is sensible here to use a discharge amplifier which releases correspondingly large cross sections for the oil to flow off after relief.

In addition, it emerges that due to the increase in turbine ratings it is also necessary for the control valves, and thus also the actuators operating them to be designed to be larger and stronger, respectively. A corresponding proportional enlargement of the actuators leads to arrangements with comparatively large amounts of pressurized oil for the purpose of operating them. With commercially available valves, such amounts of oil can be controlled only with great difficulty, added to which the dynamics of the actuator thus also suffer with increasing size.

An operating mechanism for a hydraulic actuator which operates a control valve is known from the document EP-A1-0,430,089. A control loop sets the actuator in accordance with a desired value prescribed by a master plant control and protection system. The discharge amplifier is provided in this case as a plate valve which permits the oil to flow off very rapidly from the drive volume. The plate of the plate valve has at least one cutout which permits cooperation between the pressurized oil in the spring chamber thereof and the oil in the drive volume of the actuator.

Such automatic controls must operate stably in all operating situations, in order to be able to meet the high demands on operational reliability and dynamics. An operating mechanism for a hydraulic actuator which meets these demands can be realized in a conventional way only with a comparatively high outlay.

SUMMARY OF THE INVENTION

Accordingly, one object of the invention, as it is defined in the independent claims, is to provide a novel operating mechanism for a hydraulic actuator having a pressure-proportional actuating signal which can be produced simply and cost-effectively.

The advantages achieved by the invention are to be seen essentially in that despite the improved economic efficiency of the operating mechanism for the hydraulic actuator it is not necessary to accept any losses relating to the operational reliability and dynamics thereof.

It is particularly advantageous to improve an operating mechanism for a hydraulic actuator having an amplifier for electric signals, having at least one electrohydraulic transducer connected upstream of the hydraulic actuator, and having a hydraulic discharge amplifier provided between the electrohydraulic transducer and the actuator, by interconnecting between the actuator and the hydraulic discharge amplifier a piston/cylinder arrangement acting as a transducer.

In addition, it is advantageous that in the case of the operating mechanism the piston/cylinder arrangement is assembled with a first plate valve serving as a discharge amplifier to form a joint component.

A further design of the operating mechanism which is particularly space-saving is produced when a second plate valve, which is designed as part of the safety oil circuit, is assembled with the piston/cylinder arrangement and the first plate valve to form a joint component.

In addition, it proves to be advantageous with regard to simplified production of the operating mechanism that the plate valve, which has a plate and a spring which is applied thereto and is arranged in a spring chamber, is arranged inside the piston, provided with openings, of the piston/cylinder arrangement.

It proves to be particularly advantageous with regard to a design of the operating mechanism which is effective in terms of safety that the spring chamber of the first plate valve is permanently connected to an outlet for the oil via an adapted restrictor.

Further embodiments of the invention are the subject-matter of the dependent claims.

BRIEF DESCRIPTION OF THE DRAWINGS

A more complete appreciation of the invention, its development and many of the attendant advantages thereof will be readily obtained as the same becomes better understood by reference to the following detailed description when considered in connection with the accompanying drawings, which represent only one possible mode of embodiment, wherein.

DESCRIPTION OF THE PREFERRED EMBODIMENTS

Figure 1:
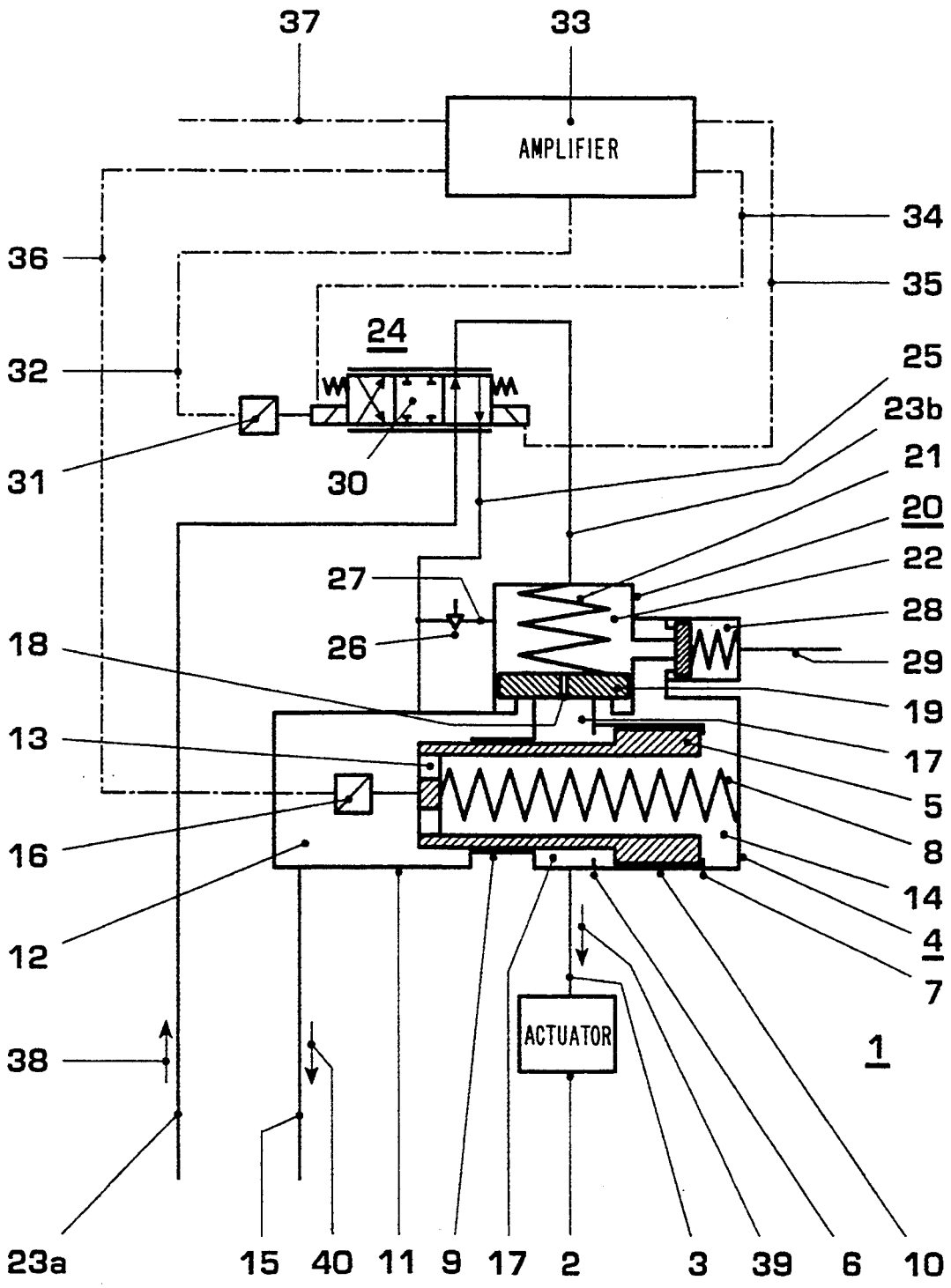
FIG. 1 shows a first embodiment of an operating mechanism according to the invention for a hydraulic actuator, in normal operation.

Referring now to the drawings, wherein like reference numerals designate identical or corresponding parts throughout the several views, all the elements not required for directly understanding the invention are not represented, and in addition some visual edges are omitted to improve clarity.

FIG. 1 shows a diagrammatically represented operating mechanism 1 for a hydraulic actuator 2 having a pressure-proportional actuating signal. Here, only one actuator 2 is represented, but as a rule the operating mechanism 1 always operates a plurality of actuators 2 at the same time. The actuator 2 is hydraulically connected via a line 3 to a piston/cylinder arrangement 4. This piston/cylinder arrangement 4 has a piston 5 which can be operated by oil pressure to move between two stops 6, 7 against the force of a spring 8. The piston 5 slides in a cylinder 11, into which two guides 9, 10 which are provided with seals (not represented here) are recessed. The cylinder 11 has in addition a buffer volume 12 which is connected by means of cutouts 13 to a spring chamber 14 on the other side of the piston 5. The buffer volume 12 and the spring chamber 14 are connected via a line 15 provided with a comparatively large cross section to an outlet (not represented here) for the oil. The buffer volume 12 and the spring chamber 14 are not filled with oil in normal operation. A position transmitter 16 connected to the piston 5 is arranged in the buffer volume 12.

The two guides 9, 10 or the seals provided there seal a high-pressure channel 17 off from the buffer volume 12. The line 3 opens into this high-pressure channel 17. Pressurized oil is fed into the high-pressure channel 17 through a restrictor 18, which is constructed as a cutout through a plate 19 of a plate valve 20. In the closed state, the plate valve 20 of conventional design separates the high-pressure channel 17 from the buffer volume 12. A spring 21 presses the plate 19 against the seat of the seal. The plate 19 is guided in the plate valve 20 such that it is prevented from tilting or jamming. The spring 21 is arranged in a spring chamber 22 filled with pressurized oil. The pressurized oil is fed through a line **23*a*, which leads to an electrohydraulic transducer 24, and a line 23*b*, which leads pressurized oil away from the electrohydraulic transducer 24 into the spring chamber 22. The pump arrangement for feeding into the line 23*a*, which applies the pressurized oil, and any pressure accumulators and pressure switches in this region are not represented here. A line 25, which is interrupted in this position of the electrohydraulic transducer 24, leads from the latter into the buffer volume 12. The spring chamber 22 is connected to the line 25 via a line 27 provided with a restrictor 26. An arrow 38 indicates the flow direction of the pressurized oil flowing into the line 23*a*. An arrow 39 indicates the flow direction of the pressurized oil flowing into the actuator 2 through the line 3. An arrow 40 indicates the flow direction of the oil flowing off into the outlet through the line 15**.

In addition, the spring chamber 22 is connected via a further plate valve 28 to a line 29 which belongs to the safety oil circuit of the plant. In the event of a pressure drop in the safety oil circuit, this plate valve 28 opens and the pressure prevailing in the spring chamber 22 decreases into the spring chamber 14, whereupon the plate valve 20 also opens, as a result of which the actuator 2 moves very rapidly into its off position. The oil emerging into the spring chamber 14 and into the buffer volume 12 is always led off very rapidly into the outlet through the line 15, so that the movement of the piston 5 cannot be influenced by this oil.

Figure 2:
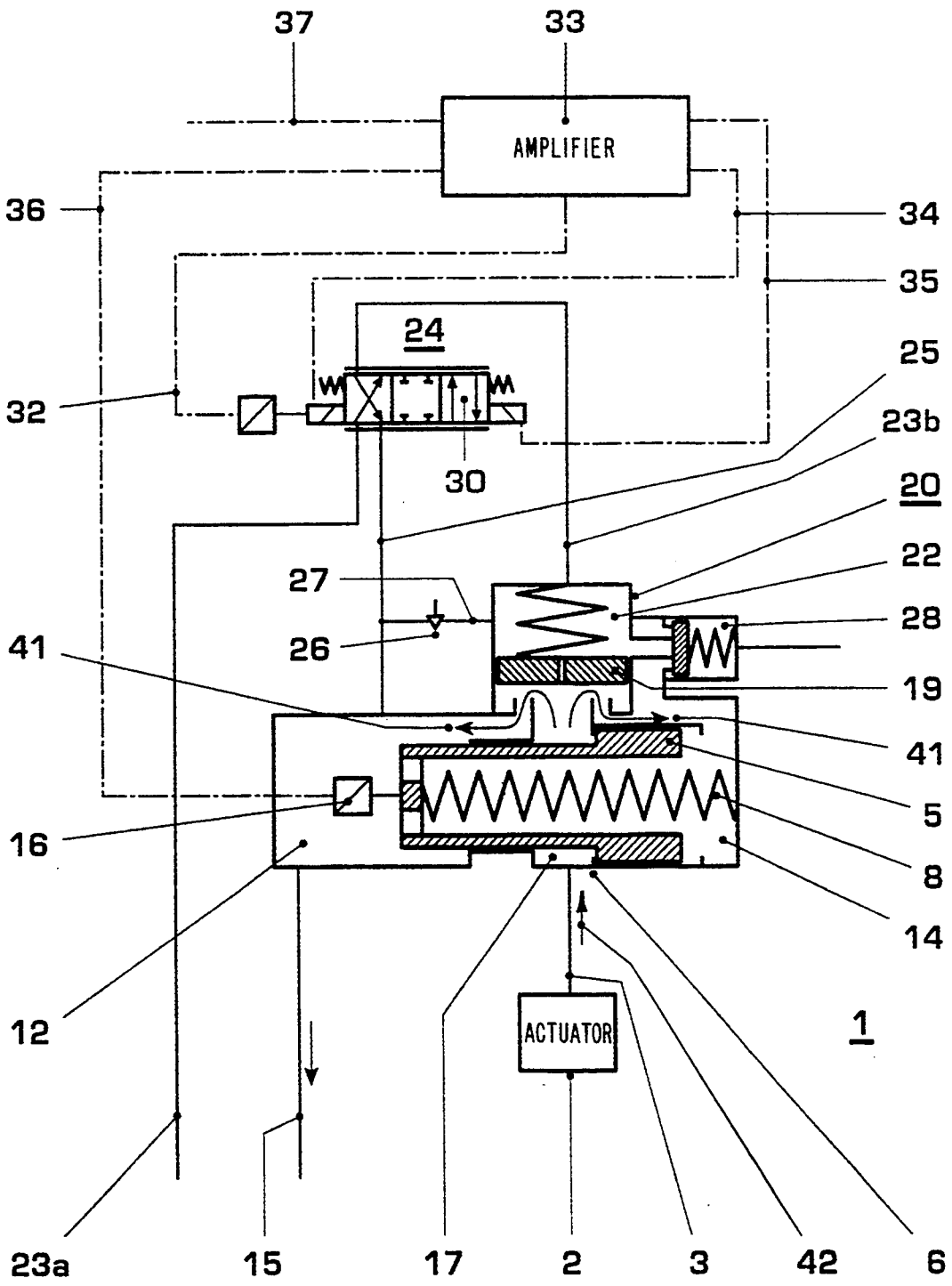
FIG. 2 shows the first embodiment of the operating mechanism according to the invention for a hydraulic actuator, in the relieved state.
Figure 3:
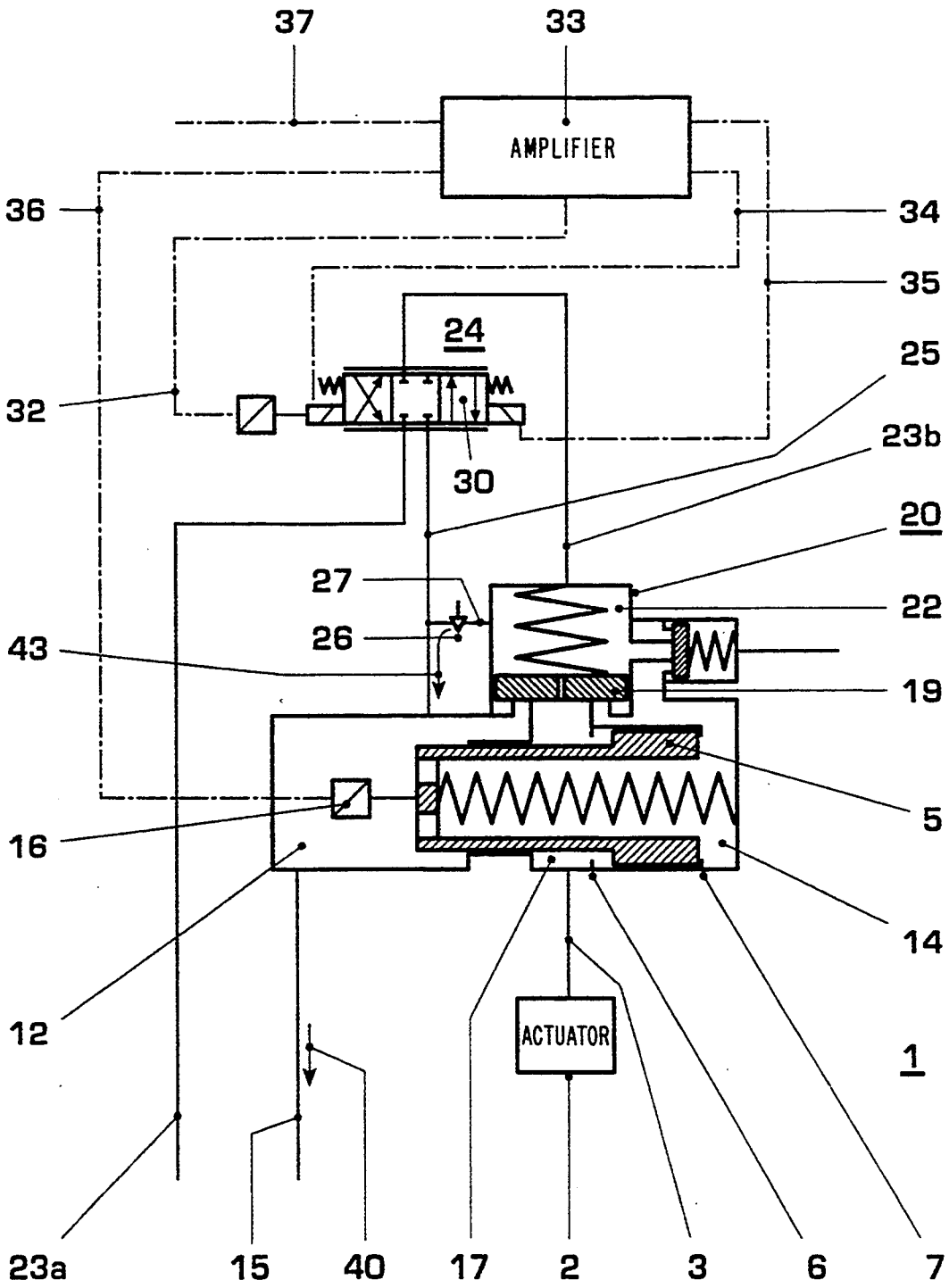
FIG. 3 shows the first embodiment of the operating mechanism according to the invention for a hydraulic actuator in an intermediate position.

It is possible, for example, to use a proportional valve 30 with position control as the electrohydraulic transducer 24, as represented in FIG. 1. This design of the proportional valve 30 has, for example, two operating coils, for the electric operation and two springs for the mechanical operation of the valve piston. The proportional valve 30 can assume three operating positions, specifically the first position, shown in FIG. 1, with excited operating coils for normal operation, a second position, which is shown in FIG. 2, for relief, and a third position, which is shown in FIG. 3, precisely when no correction of the position of the actuator 2 is required, or when the operating voltage has failed, so that the springs press the valve piston into the middle position. In the operating position represented in FIG. 1, a sealing edge, currently in use, of the proportional valve 30 controls the quantity of the pressurized oil flowing through the lines **23*a* and 23*b*. The proportional valve 30 is provided with a position transmitter 31, whose position measuring signals are, as indicated by an action line 32, led into an amplifier 33 for further processing. Action lines 34 and 35 emanating from the amplifier 33 indicate the electric supply leads for the operating coils of the proportional valve 30. In addition, the amplifier 33 is, as shown by an action line 36, connected to the position transmitter 16 of the piston/cylinder arrangement 4, so that the position measuring signals generated there also pass into the amplifier 33 for further processing. A further action line 37 indicates the connection between the amplifier 33 and a master plant control and protection system. The amplifier 33 can be designed as a pure amplifier. However, it frequently proves to be very sensible to provide specific elements acting as controllers in the amplifier 33 itself, in order in this way to achieve particularly rapid signal processing and thus a high dynamic performance of the operating mechanism 1. Only the measuring signals generated by the position transmitter 16** are combined with prescribed desired values in the master plant control and protection system.

The proportional valve 30 is represented in FIG. 2 in the relieved operating state. In this case, the feeding line **23*a* is interrupted by the proportional valve 30, and the line 23*b* is connected to the line 25, so that the oil can flow off from the spring chamber 22 into the outlet. As a consequence of the pressure drop, bound up therewith, in the spring chamber 22, the plate valve 20 opens, so that, as indicated by the arrows 41, the oil can flow off very rapidly from the high-pressure channel 17 into the buffer volume 12 and further into the outlet through the line 15, which has a large cross section. This has the further consequence that the piston 5 is pressed to the left by the spring 8 against the stop 6. The oil from the drive volume of the actuator 2 flows at the same time, as shown by the arrow 42, through the line 3 into the high-pressure channel 17** and from there further into the outlet.

The proportional valve 30 is represented in FIG. 3 in the operating state, in which the operating voltage has failed and the springs determine the indicated position of the valve. In this case, both the feeding line 23*a* and the line 23*b* are blocked by the proportional valve 30. FIG. 3 shows the instant immediately after the failure of the operating voltage. In addition, it is assumed that at this instant the safety oil circuit has not yet responded. Pressurized oil is applied to the spring chamber 22, and this pressure cannot be decreased by the blocked line 23*b*, with the result that the actuator 2 is blocked in the position which it had assumed before the failure of the operating voltage. Such a blockage of the actuator 2 is impermissible for safety reasons, since the turbine whose feed valve is controlled by means of this actuator 2 can now no longer be shut down. The line 37 having the permanently active restrictor 26 has been provided in order with its assistance to avoid such extremely critical operating states. A small quantity of oil flows off continuously through this restrictor 26, this quantity being continuously replaced in normal operation by the pressurized oil fed through the line 23*b*, although in the present operating case the quantity of oil flowing off is sufficient to decrease the pressure in the spring chamber 22 within a useful period. At the same time, the pressure in the high-pressure channel 17 and thus also in the actuator 2 is decreased by the restrictor 18, which penetrates the plate 19. The actuator 2 is led immediately by this pressure decrease into the defined off position. The undefined operating state can thus be overcome sufficiently rapidly and reliably. As a rule, in such a case the safety oil circuit will also respond and ensure the pressure decrease in the spring chamber 22. Consequently, a particularly advantageous redundancy of the safety devices is present here.

Figure 4:
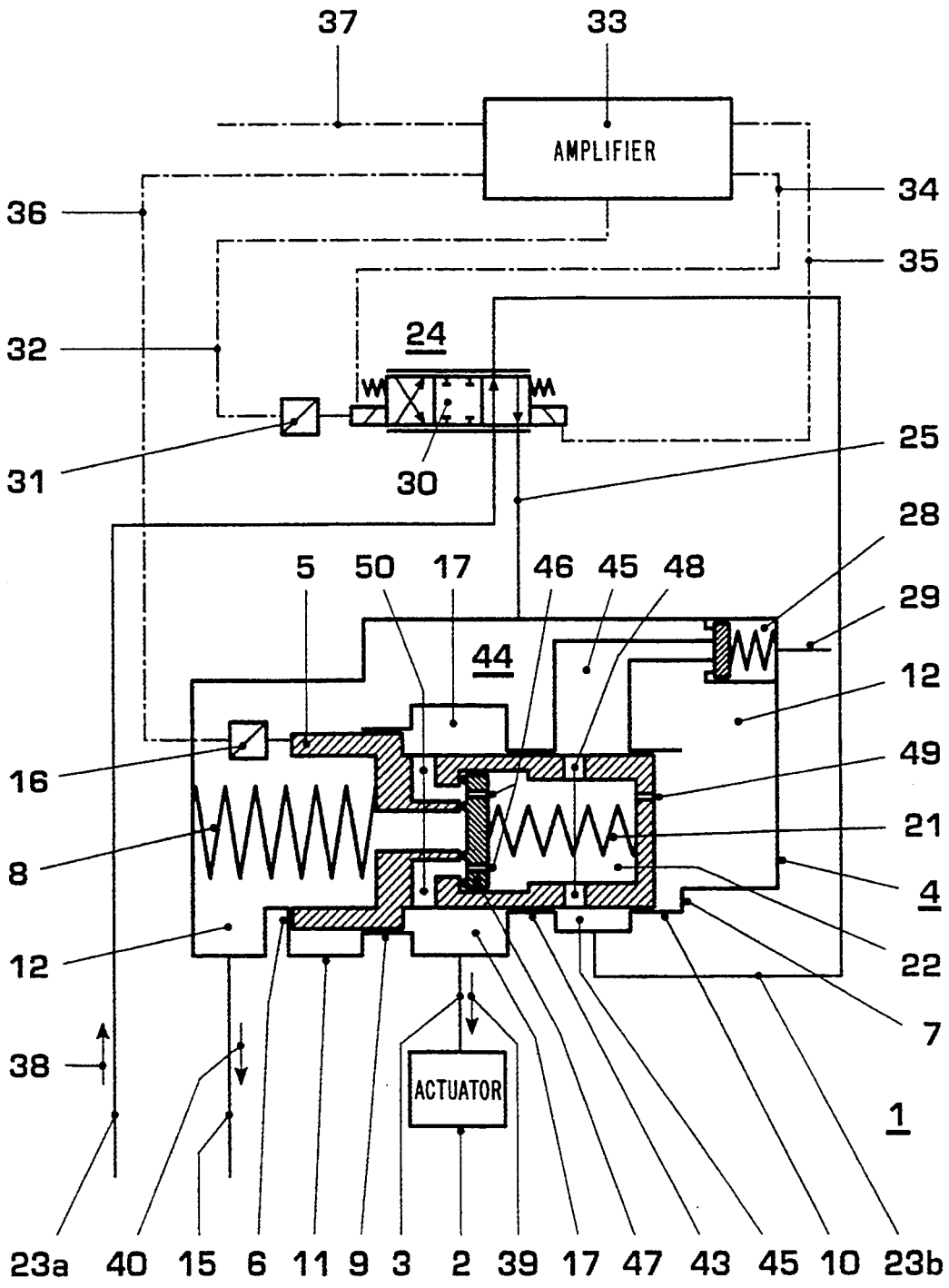
FIG. 4 shows a second embodiment of an operating mechanism according to the invention for a hydraulic actuator in normal operation.

Like FIG. 1, FIG. 4 shows a diagrammatically represented operating mechanism 1 for a hydraulic actuator 2 having a pressure-proportional actuating signal. The actuator 2 is hydraulically connected via a line 3 to a piston/cylinder arrangement 4. This piston/cylinder arrangement 4 has a piston 5 which can be operated by oil pressure to move between two stops 6, 7 against the force of a spring 8. The piston 5 slides in a cylinder 11, into which three guides 9, 10 and 43 which are provided with seals (not represented here) are recessed. The cylinder 11 has in addition a buffer volume 12. The buffer volume 12 is connected via a line 15 which has a relatively large cross section to an outlet (not represented here) for the oil. The buffer volume 12 is not normally filled with oil. A position transmitter 16 connected to the piston 5 is arranged in the buffer volume 12.

The three guides 9, 10 and 43, or the seals provided there, seal a high-pressure channel 17 and a high-pressure channel 45 off from one another and from the buffer volume 12. Line 3 opens into the high-pressure channel 17, and the line 23b opens into the high-pressure channel 45. Pressurized oil is fed through bores 46, which are constructed as restrictors and extend through a plate 47 of a plate valve 44, into a channel 50 provided with a comparatively large cross section. The channel 50 is connected to the high-pressure channel 17. In the closed state, the plate valve 44 arranged inside the piston 5 separates the high-pressure channel 17 and together with the latter the channel 50 from the buffer volume 12. A spring 21 presses the plate 47 against the seat of the seal. The plate 47 is guided in the plate valve 44 such that it is prevented from tilting or jamming. The spring 21 is arranged in a spring chamber 22 filled with pressurized oil inside the piston 5. The pressurized oil is fed through a line 23*a*, which leads to an electrohydraulic transducer 24, and a line 23*b*, which leads pressurized oil away from the electrohydraulic transducer 24 into the high-pressure channel 45. The oil passes from the high-pressure channel 45 into the spring chamber 22 through openings 48 in the wall of the piston 5. The pump arrangement for feeding into the line 23*a*, which applies the pressurized oil, and any pressure accumulators and pressure switches in this region are not represented here. A line 25, which is interrupted in this position of the electrohydraulic transducer 24, leads from the latter into the buffer volume 12.

The spring chamber 22 is permanently connected to the buffer volume 12 and via the latter to the line 25 via a restrictor 49, which is recessed as a fine bore into the bottom of the piston 5. The restrictor 49 operates in the case of operation, as described in conjunction with FIG. 3, exactly the same as the restrictor 26 described there. An arrow 38 indicates the flow direction of the pressurized oil flowing into the line 23*a* in FIG. 5. An arrow 39 indicates the flow direction of the pressurized oil flowing into the actuator 2 through the line 3. An arrow 40 indicates the flow direction of the oil flowing off into the outlet through the line 15.

In addition, the spring chamber 22 is connected through the openings 48 and via a further plate valve 28 to a line 29 which belongs to the safety oil circuit of the plant. In the event of a pressure drop in the safety oil circuit, this plate valve 28 opens and the pressure prevailing in the spring chamber 22 decreases through the openings 48 into the buffer volume 12, so that the plate valve 44 also opens, as a result of which the actuator 2 moves very rapidly into its off position.

A proportional valve 30 with position control has likewise been used here as the electrohydraulic transducer 24, as has already been represented in FIG. 1. The proportional valve 30 has, for example, two operating coils, for the electric operation and two springs for the mechanical operation of the valve piston and it can, as already described, assume three operating positions. In the operating position represented in FIG. 4, a sealing edge, currently in use, of the proportional valve 30 controls the quantity of the pressurized oil flowing through the lines 23*a* and 23*b*. The proportional valve 30 is provided with a position transmitter 31, whose position measuring signals are, as indicated by an action line 32, led into an amplifier 33 for further processing. Action lines 34 and 35 emanating from the amplifier 33 indicate the electric supply leads for the operating coils of the proportional valve 30. In addition, the amplifier 33 is, as shown by an action line 36, connected to the position transmitter 16 of the piston/cylinder arrangement 4, so that the position measuring signals generated there also pass into the amplifier 33 for further processing. A further action line 37 indicates the connection between the amplifier 33 and a master plant control and protection system. The amplifier 33 can be designed as a pure amplifier. However, it frequently proves to be very sensible to provide specific elements acting as controllers in the amplifier 33 itself, in order in this way to achieve particularly rapid signal processing and thus a high dynamic performance of the operating mechanism 1.

Figure 5:
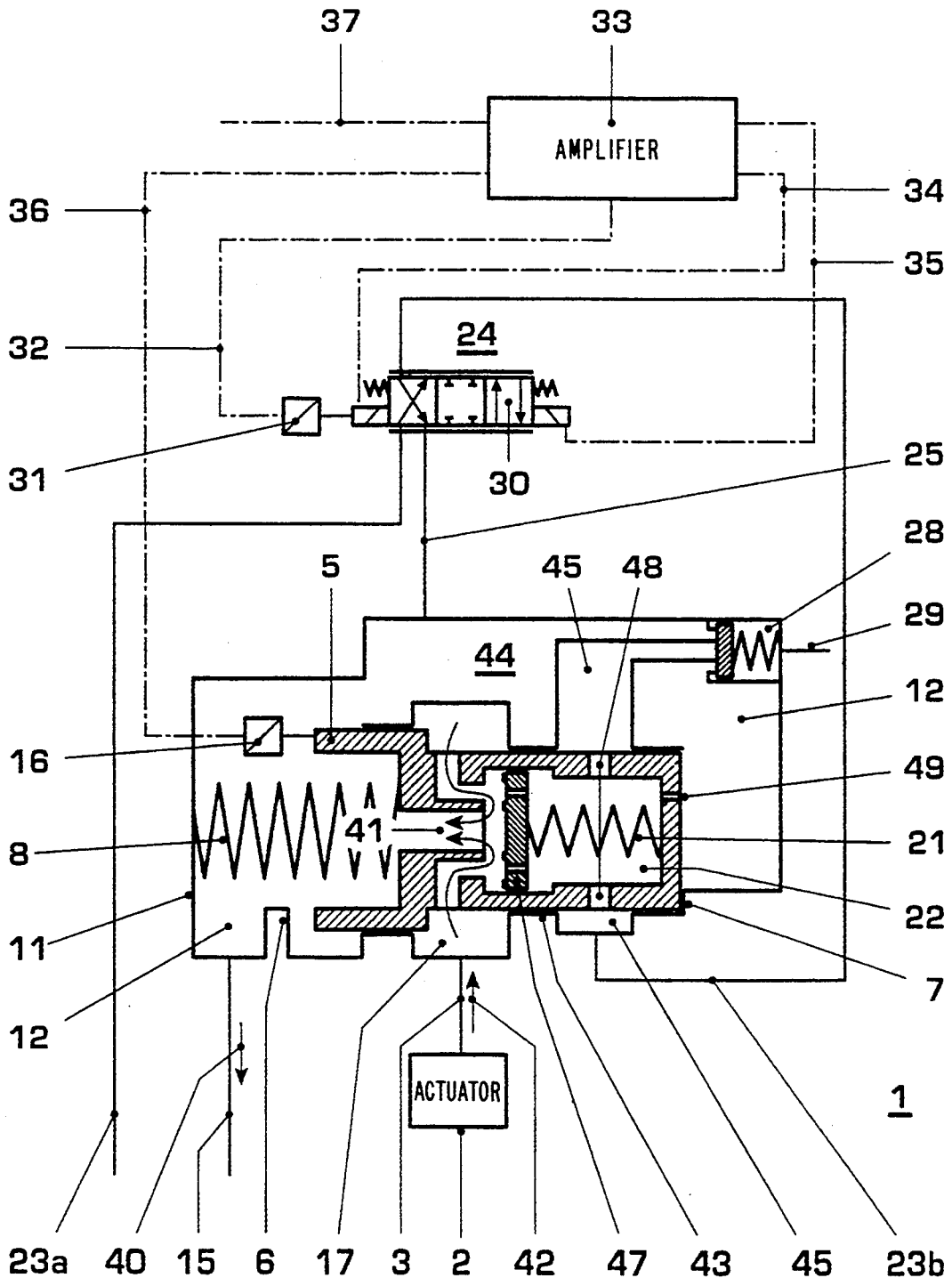
FIG. 5 shows the second embodiment of the operating mechanism according to the invention for a hydraulic actuator in the relieved state.

The proportional valve 30 is represented in FIG. 5 in the relieved operating state. In this case, the feeding line 23*a* is interrupted by the proportional valve 30, and the line 23*b* is connected to the line 25, so that the oil can flow off from the spring chamber 22 into the outlet. As a consequence of the pressure drop, bound up therewith, in the spring chamber 22, the plate valve 44 opens, so that, as indicated by the arrows 41, the oil can flow off through the channel 50 from the high-pressure channel 17 into the buffer volume 12 and further into the outlet through the line 15. This has the further consequence that the piston 5 is pressed to the right by the spring 8 against the stop 7. The oil from the drive volume of the actuator 2 flows at the same time, as shown by the arrow 42, through the line 3 into the high-pressure channel 17 and from there further into the outlet so that the actuator 2 moves rapidly into its off position.

The drawing will now be examined in somewhat more detail for a further explanation of the mode of operation. In FIG. 1, a volumetric flow consisting of pressurized oil is controlled by the electrohydraulic transducer 24. This volumetric flow is converted into a pressure signal by the piston/cylinder arrangement 4, which serves as a transducer. This pressure signal acts in the high-pressure channel 17 and holds the piston 5 in the position shown against the force of the spring 8. The position transmitter 16, which is connected to the piston 5, signals this position of the piston 5 to a controller which compares it with a desired value prescribed by the master plant control and protection system, and which causes any necessary corrections via the amplifier 33 and the electrohydraulic transducer 24. Each correction acts as a change in the volumetric flow through the electrohydraulic transducer 24, and is converted in the piston/cylinder arrangement 4 into a corresponding pressure. This pressure, which is active in the high-pressure channel 17, acts on the actuator 2 or a plurality of actuators 2 and determines the stroke thereof. This pressure can be increased if the actuator 2 is intended to open further the feed valve, which it operates, for the turbine. For this purpose, the excitation of the operating coils of the proportional valve 30 is changed so that the control edge engaged releases a larger cross section for the oil flowing through. The measuring signals of the position transmitter 16 are monitored and compared with prescribed desired values in the master plant control and protection system, so that any defective deviation from known values is detected immediately. A specific rate of pressure change and, in addition, a specific travel speed of the piston 5 and of the actuator 2 thus correspond to a specific change in cross section of the proportional valve 30. The piston/cylinder arrangement 4 acts as a transducer. The direct measurement of the position of the piston 5, and the linking of these measuring signals into the control process, which is controlled by the master plant control and protection system, prevents instabilities in this region with great reliability. The embodiment of the operating mechanism in accordance with FIG. 4, which is somewhat more economical, also has the essential advantages of the embodiment described here.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An operating mechanism for a hydraulic actuator, comprising:

a source of pressurized hydraulic fluid;

a conduit arrangement interconnecting the source of pressurized hydraulic fluid with the actuator for conducting pressurized hydraulic fluid thereto;

an electrically actuated proportional valve disposed in the conduit arrangement upstream of the actuator for varying a volumetric flow of pressurized hydraulic fluid to the actuator to vary an extent of movement of the actuator;

a hydraulic discharge amplifier disposed in the conduit arrangement downstream of the proportional valve for quickly releasing hydraulic fluid from the actuator in response to a pressure drop in hydraulic fluid from the proportional valve;

a transducer disposed in the conduit arrangement downstream from the hydraulic discharge amplifier and upstream from the actuator, the transducer including a piston movably disposed in a cylinder, the transducer including means for generating a pressure proportional electric actuating signal in accordance with an extent of movement of the piston; and means, responsive to the pressure proportional electric actuating signal, for controlling the proportional valve to vary the volumetric flow of pressurized hydraulic fluid to the actuator.

2. The operating mechanism for a hydraulic actuator as set forth in claim 1, wherein the transducer includes a spring disposed in the cylinder for opposing movement of the piston.

3. The operating mechanism for a hydraulic actuator as set forth in claim 1, wherein the pressure proportional electric actuating signal generating means includes a position transmitter for generating a signal based on a position of the piston in the cylinder.

4. The operating mechanism for a hydraulic actuator as set forth in claim wherein the hydraulic discharge amplifier includes a plate valve assembly.

5. The operating mechanism for a hydraulic actuator as set forth in claim 4, further comprising a second hydraulic discharge amplifier for quickly releasing hydraulic fluid from the actuator in response to a pressure drop in hydraulic fluid from a safety oil circuit.

6. The operating mechanism for a hydraulic actuator as set forth in claim 5, wherein the second hydraulic discharge amplifier is formed integrally with the hydraulic discharge amplifier and the transducer.

7. The operating mechanism for a hydraulic actuator as set forth in claim 6, wherein the second hydraulic discharge amplifier includes a plate valve assembly.

8. The operating mechanism for a hydraulic actuator as set forth in claim 4, wherein the plate valve assembly includes a spring chamber, a plate disposed in the spring chamber, volumetric flow of pressurized hydraulic fluid flowing from the spring chamber to the transducer through an orifice in the plate, and a spring disposed in the spring chamber for opposing movement of the plate due to pressurized hydraulic fluid in the transducer.

9. The operating mechanism for a hydraulic actuator as set forth in claim 8, wherein the plate valve assembly is arranged inside the piston of the transducer.

10. The operating mechanism for a hydraulic actuator as set forth in claim 8, further comprising an oil outlet and a conduit connecting the spring chamber to the oil outlet, the conduit having a restrictor therein.

* * * * *